US007968831B2

(12) United States Patent
Meyer et al.

(10) Patent No.: US 7,968,831 B2
(45) Date of Patent: Jun. 28, 2011

(54) SYSTEMS AND METHODS FOR OPTIMIZING THE AIMPOINT FOR A MISSILE

(75) Inventors: Richard E. Meyer, Florissant, MO (US); William J. Ebert, Kirkwood, MO (US); James V. Leonard, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 375 days.

(21) Appl. No.: 11/761,584

(22) Filed: Jun. 12, 2007

(65) Prior Publication Data

US 2008/0308670 A1 Dec. 18, 2008

(51) Int. Cl.

| | |
|---|---|
| ***F42B 15/01*** | (2006.01) |
| ***F41G 7/30*** | (2006.01) |
| *F42B 15/00* | (2006.01) |
| *F41G 7/00* | (2006.01) |

(52) U.S. Cl. ..... 244/3.15; 244/3.1; 244/3.11; 382/100; 382/103; 701/1; 701/2; 701/3

(58) Field of Classification Search ..... 244/3.1–3.3; 89/1.11; 342/52–68, 89, 90, 175, 195, 91–93, 342/176, 179, 182, 183; 382/100, 103; 701/1, 701/2, 3; 235/400, 404–407, 411–418
See application file for complete search history.

(56) References Cited

U.S. PATENT DOCUMENTS

| | | | | |
|---|---|---|---|---|
| 3,567,163 | A * | 3/1971 | Kepp et al. | 244/3.14 |
| 3,974,328 | A * | 8/1976 | Thomas et al. | 244/3.17 |
| 4,005,415 | A * | 1/1977 | Kossiakoff et al. | 342/90 |
| 4,103,847 | A * | 8/1978 | Thomas et al. | 244/3.18 |
| 4,267,562 | A * | 5/1981 | Raimondi | 89/1.11 |
| 4,274,609 | A * | 6/1981 | Ferrier et al. | 244/3.14 |
| 4,424,943 | A * | 1/1984 | Zwirn et al. | 244/3.11 |
| 4,497,065 | A * | 1/1985 | Tisdale et al. | 382/103 |
| 5,332,176 | A * | 7/1994 | Wootton et al. | 244/3.11 |
| 5,341,435 | A * | 8/1994 | Corbett et al. | 382/103 |
| 5,381,154 | A * | 1/1995 | Guerci | 342/90 |
| 5,524,845 | A * | 6/1996 | Sims et al. | 244/3.17 |
| 5,605,307 | A * | 2/1997 | Batchman et al. | 244/3.11 |
| 5,755,400 | A * | 5/1998 | Kalms, III | 244/3.17 |
| 5,931,410 | A * | 8/1999 | Feierlein et al. | 244/3.19 |
| 5,947,413 | A * | 9/1999 | Mahalanobis | 244/3.17 |
| 6,042,050 | A * | 3/2000 | Sims et al. | 244/3.17 |
| 6,142,410 | A * | 11/2000 | Naccache | 244/3.12 |
| 6,349,898 | B1 * | 2/2002 | Leonard et al. | 244/3.15 |
| 7,032,858 | B2 * | 4/2006 | Williams | 244/3.15 |
| 7,040,570 | B2 * | 5/2006 | Sims et al. | 244/3.16 |
| 7,236,121 | B2 * | 6/2007 | Caber | 342/62 |
| 7,345,265 | B2 * | 3/2008 | Page | 244/3.1 |
| 7,411,543 | B1 * | 8/2008 | Boka | 342/90 |
| 2005/0087649 | A1 * | 4/2005 | Sims et al. | 244/3.16 |
| 2006/0073438 | A1 * | 4/2006 | Page | 244/3.1 |
| 2007/0098219 | A1 * | 5/2007 | Spence et al. | 382/103 |

* cited by examiner

OTHER PUBLICATIONS

Devore et al., "Performance Complexity Study of Several Approaches to Automatic Target Recognition from SAR Images", IEEE Transactions on Aerospace and Electronic Systems, Apr. 2002, VI 38, Issue 2, pp. 632-648.

*Primary Examiner* — Bernarr E Gregory
(74) *Attorney, Agent, or Firm* — Caven & Aghevli LLC

(57) ABSTRACT

Methods and systems are disclosed that automatically display an optimized aimpoint on a target image in received seeker data. In one embodiment, a method receives missile seeker target data. A seeker mode data is extracted from the received missile seeker target data. The location of a most vulnerable spot on a target is identified based on a comparison of target library data with seeker image data. A marker is generated at the location of the optimized aimpoint and output to a display.

18 Claims, 3 Drawing Sheets

SYSTEMS AND METHODS FOR OPTIMIZING THE AIMPOINT FOR A MISSILE

BACKGROUND OF THE INVENTION

1. Field of the Invention

The disclosure relates to systems and methods for optimizing the aimpoint for a missile and, more particularly, to systems and methods that provide automated aimpoint update optimization.

2. Description of the Related Art

Presently, some Man-In-The-Loop (MITL) missiles and associated aircraft launch controls allow the pilot to re-designate the aimpoint of the in-flight missile's target imaging seeker. FIG. 1 illustrates an example of a system 1 that permits the pilot to re-designate the aimpoint.

The in-flight seeker image from the missile in flight 2 is linked back to the launching aircraft via a data link pod 4. The data link pod 4 is linked to the aircraft mission planning command processor 6 with a suitable data bus (e.g. 1553 data bus). The data link pod 4 sends annotated seeker image video to the command processor 6. The command processor 6 sends the annotated video to the aircraft display 8 where the annotated seeker image is displayed on the display 8 with the aimpoint shown at the center of the display 8. The pilot can improve or change the aimpoint by commanding an aimpoint update by depressing and holding a switch on the stick control 10. The data link pod 4 relays this command to the in-flight missile 2 and the missile 2 notes the video frame that the pilot used to update the aimpoint.

Using control stick 10, the pilot can position a cursor overlaid on the seeker image on the cockpit display to a more desirable target location by moving the control stick 10. With the cursor positioned, the pilot releases the switch which immediately causes the position of the cursor on the image to be sent to the in-flight missile as the new commanded aimpoint. The missile seeker is aimed at the new aimpoint and the video resumes, such that the pilot can verify the aimpoint update. This process can be repeated until the missile 2 hits the target. This process takes time and the positioning is coarse and usually requires repetition, and the target impact point is not optimized.

Accordingly, there is a need for an automated system and method for providing an optimized aimpoint.

BRIEF SUMMARY OF THE INVENTION

The present invention addresses the problems identified above by providing methods, equipment, and systems that can automatically suggest an updated aimpoint. Embodiments of systems and methods in accordance with the present disclosure may advantageously reduce the workload of the pilot, and optimizes the accuracy and timing of the missile updating process.

One embodiment provides a computerized method of using the returned seeker video from a missile in flight to find the mission target in the seeker image, locate the precise optimized software generated aimpoint on the target in the returned seeker image, and output the optimized aimpoint as a pixel location in the image.

A further embodiment uses the seeker video returned from the missile in flight. In this embodiment, the target is found in the returned video image and the system computes the precise optimized pixel location in the returned image for the missile aimpoint update. Thereafter the system positions the launcher cursor overlay on the launch crew display of the seeker image.

Embodiments in accordance with the present disclosure may improve the accuracy of a Man-In-The-Loop (MITL) missile (or any missile with a retargeting data link and video) by providing the pilot or controller with an autonomous target aim point update assist. This improvement may be accomplished in the aircraft launch equipment software, without requiring expensive and lengthy recertification of the aircraft, launch system or the missile.

Another embodiment assists the pilot in the positioning of the cursor by instantly suggesting a precise software generated aimpoint update location. The pilot can accept the software generated update or override the software assist by positioning the update aimpoint cursor to a desired location on the image.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

The accompanying drawings incorporated in and forming part of the specification illustrate several aspects of the present invention. In the drawings.

Reference will now be made in detail to the present preferred embodiment to the invention, examples of which are illustrated in the accompanying drawings.

DETAILED DESCRIPTION OF THE INVENTION

Embodiments of methods and systems in accordance with the present disclosure may improve the accuracy of a Man-In-The-Loop (MITL) missile (or any missile with a retargeting data link and video) by providing the pilot or controller with an autonomous target aim point update assist. In some embodiments, this improvement may be accomplished in the aircraft launch equipment software, without requiring expensive and lengthy recertification of the aircraft, launch system or the missile. Other embodiments may be done in hardware or a combination of hardware and software.

One embodiment assists the pilot in the positioning of the cursor by automatically suggesting an aimpoint update location. In some embodiments cursor position represents a precise software generated aimpoint update location. The pilot can accept the software generated update or override the software assist by positioning the update aimpoint cursor to a desired location on the image.

Figure 1:
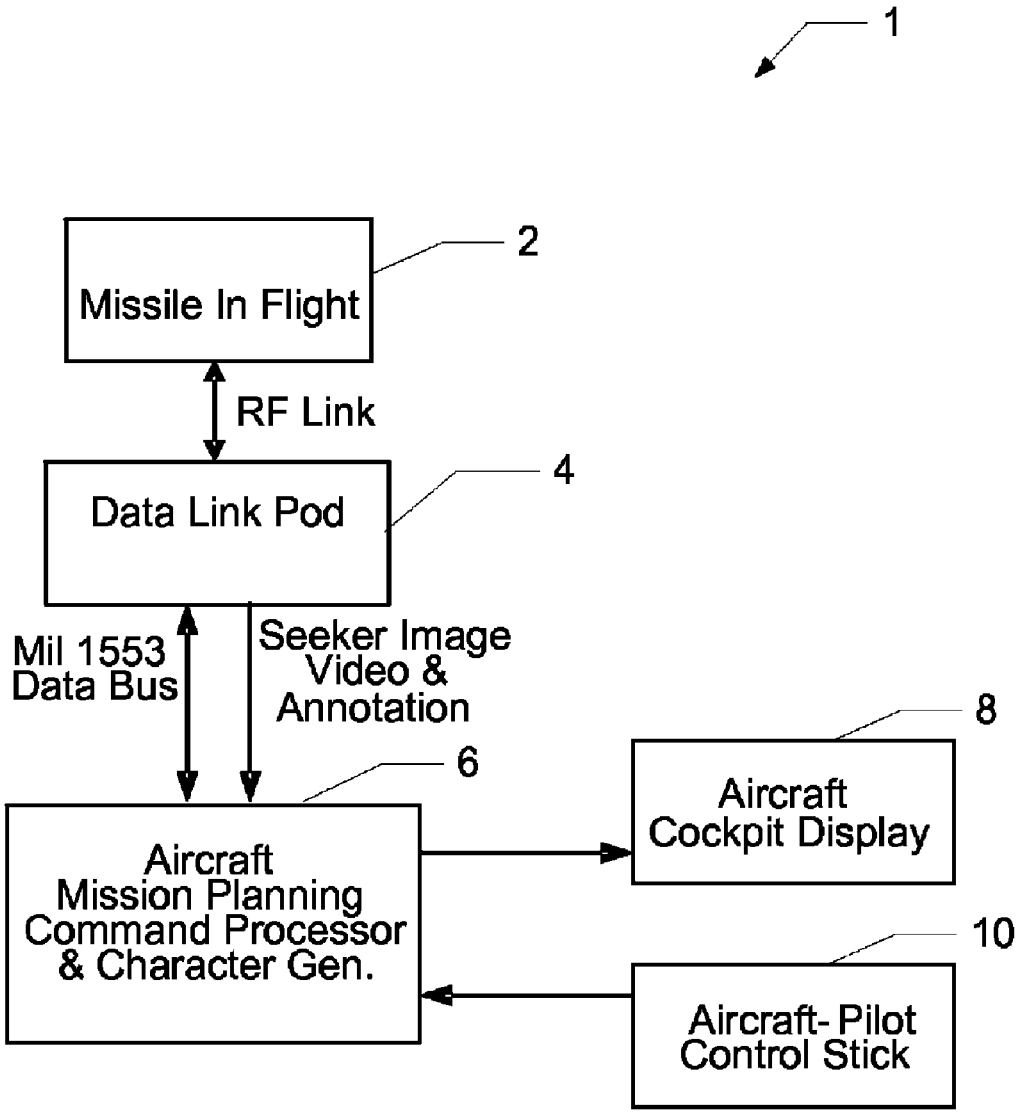
Figure 1 (PRIOR ART)
FIG. 1 illustrates a prior art system that may be used to manually update a missile's aimpoint.
Figure 2:
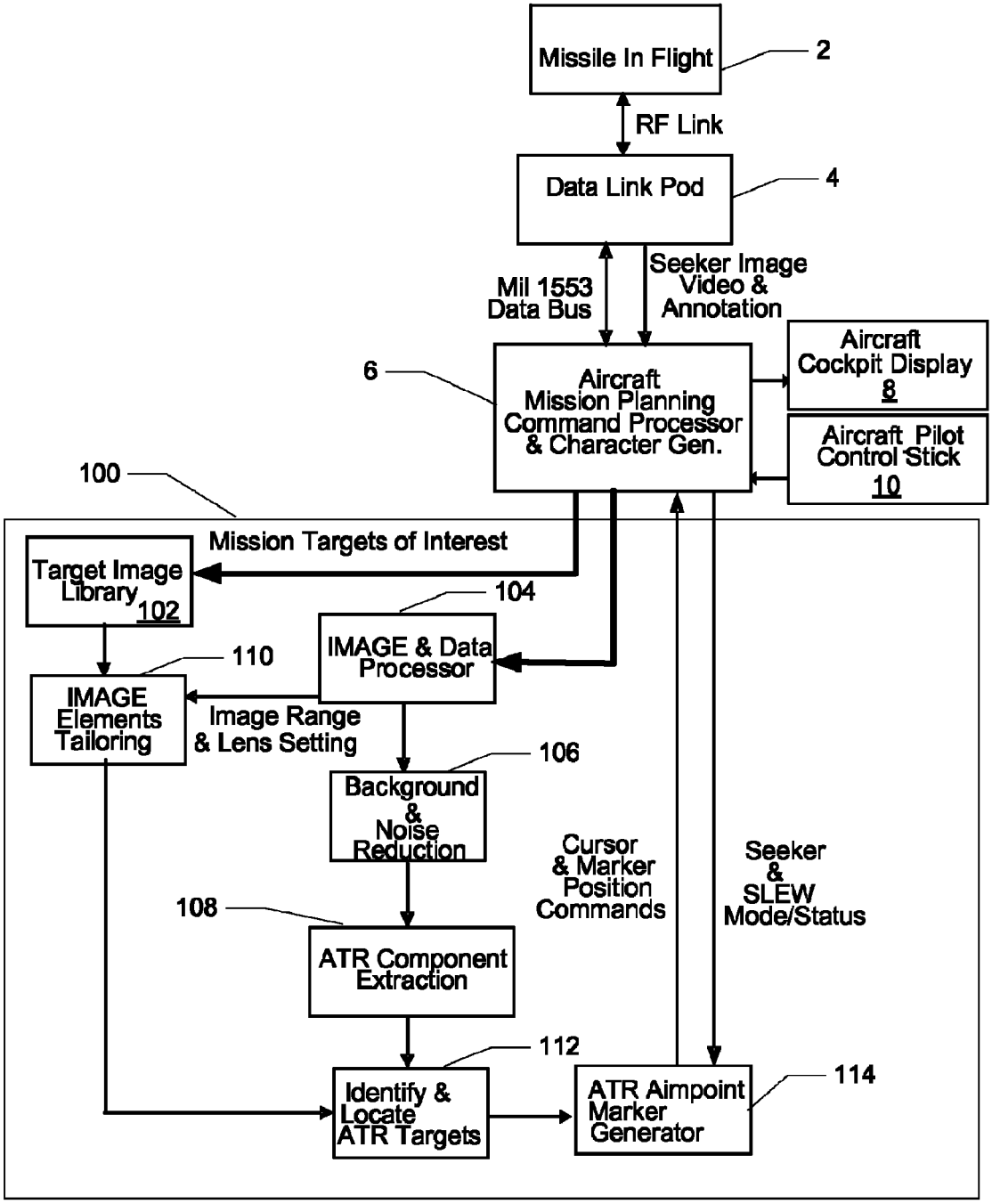
FIG. 2 illustrates one embodiment of a system that can provide an automatic aimpoint update suggestion.

FIG. 2 describes an example of a MITL retargeting system which provides the pilot with an assisted or suggested update position. Blocks 2, 4, 6, 8, and 10 were described above in reference to FIG. 1. In FIG. 2, the components shown may operate as software on single or multiple processors. Further the components may operate on one or more pieces of hardware. In some embodiments the components may be formed in hardware. In other embodiments the components may be formed in a combination of hardware, firmware and software.

FIG. 2 illustrates the interaction between the aircraft mission planning command processor 6 and an Aimpoint Optimization Device (AOD) 100 which contains an existing ATR module. The AOD device 100 receives missile data and mission data from command processor 6. The missile data may include, but is not limited to, seeker image (video, infrared, radar, etc.), annotation, missile status, seeker status, missile mode, seeker mode, slew status, slew mode, range to target, camera lens setting, field of view, etc. The mission data may include, but is not limited to the mission target or targets of interest.

The AOD device 100 may send cursor or marker position commands or location to the command processor 6. The command processor 6 may use the location or position commands to cause cockpit display 8 to display the marker or cursor at the optimized position.

A target image library 102 may receive the identity of mission target(s) from the aircraft mission planning command processor 6. This library 102 contains missile target image sets. Each image set may contain one or more images of targets. In some embodiments, each image set includes images of potential targets taken from different ranges (distances), azimuth directions or angles, and elevation angles. The target image library 102 outputs missile target image sets that correspond to the mission target(s) of interest. In the embodiment shown in FIG. 2, the missile target image sets that correspond to the mission target(s) of interest are output to an image elements tailoring component 110

In the embodiment shown, the image and data processor 104 receives missile data that may include seeker image data from the aircraft mission planning command processor 6. The image and data processor 104 may process the missile data into a format suitable for automatic target recognition (ATR) processing. In some embodiments, the ATR format is a digital format. In some embodiments, the digital format may represent a combination of two interlaced frames of video that preserves the annotation areas. In other embodiments, the pixel intensity in the image fields may be compressed to avoid saturation.

The ATR formatted data may be sent from the image and data processor 104 to a background and noise reduction component 106. The background and noise reduction component 106 reduces the noise in the ATR formatted data. In some embodiments, the background and noise reduction component 106 may analyze the ATR formatted data for signal-to-noise ratio. In further embodiments, the background and noise reduction component 106 may also combine multiple frames of ATR data so that noise reduced ATR formatted data exceeds a predetermined ATR feature-to-noise ratio. The noise reduced ATR formatted data may be sent to an ATR component extractor 108.

The ATR component extractor 108 extracts data from the noise reduced ATR formatted data that may be used to identify and locate targets. In some embodiments, the extracted data corresponds to features and segments needed for an ATR algorithm. The extracted data may be passed to an identify and locate targets component 112.

In the embodiment shown in FIG. 2, the image and data processor also outputs the image range and lens setting(s) to the image elements tailoring component 110. In the image elements tailoring component 110, image elements in the target image set(s) output by the image library 102 may be tailored using the image range and lens setting data. The tailored image elements or image set(s) may be sent to an identify and locate targets component 112.

The identify and locate targets component 112 may compare the extracted data with the tailored image elements in order to identify the mission target. In some embodiments, the identify and locate targets component 112 will match, code, and locate the mission target in the ATR formatted data. At least the location of the identified mission target is passed to an ATR aimpoint marker generator 114 from the identify and locate targets component 112.

The ATR aimpoint marker generator 114 may receive some missile data, such as seeker and slew mode and/or status, from the aircraft mission planning command processor 6. Using the data from the identify and locate targets component 112 and the command processor 6, the ATR aimpoint marker generator 114 generates an aimpoint marker at the mission target location generated by the identify and locate targets component 112. This aimpoint marker may be sent to the command processor 6. The command processor 6 may then update the cursor position in the cockpit display 8.

Figure 3:
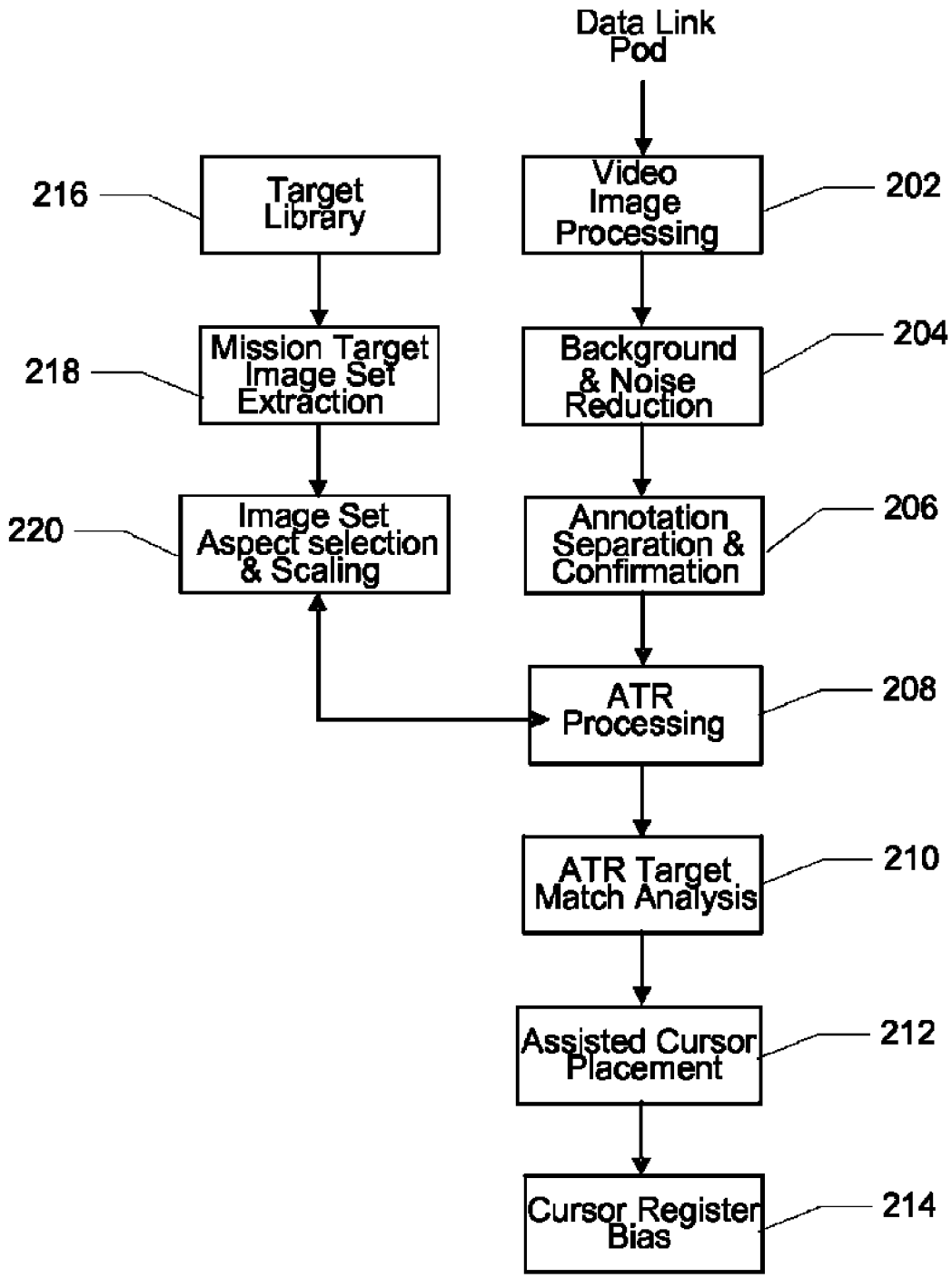
FIG. 3 provides an example of a process that may be used in the system show in FIG. 2.

FIG. 3 describes an exemplary process 200 that may be used to optimize the aimpoint. In block 202, a received MITL video data from a data link pod may be processed into an image format conforming to an ATR format. The two interlaced frames may be combined into one image format with the annotation areas preserved. Pixel intensities in the image field may be compressed to avoid saturation.

In block 204, the processed image format is analyzed for signal-to-noise ratio. Block 204 may also combine multiple frames to exceed a threshold for ATR feature-to-noise ratio (signal-to-noise ratio). Block 204 may output a noise reduced image format.

In block 206, the missile seeker annotation is read and separated from the noise reduced image format. The seeker annotation describes the current seeker modes. The modes reported in the video may be compared to the last commanded state (from the aircraft weapon control system) to verify the mode and settings that the seeker was in when the image was received.

The target library shown in block 216 contains missile target image sets. In block 218, mission planning data are used to identify and extract an image set for this mission from the library. In block 220, the range, look angle, field of view and missile seeker mode status (hot, cold, etc.) from the annotation extracted in block 206 may be used to preprocess the library image set extracted in block 218.

In block 208, the ATR processing component extracts features and segments needed by an ATR algorithm, known to those in the practice and described in IEEE reference: INSPEC Accession No. 7303990, from the image format having the annotations removed. These features and segments (elements) are then fed into the ATR algorithm and compared with the scaled target image set from the reference library to match, code, and locate the mission target.

In block 210, the matched target certainty data is compared to an ATR threshold for each detected target. The primary mission target position is identified and the location of the aimpoint of the matched & registered library target is determined in terms of the pixel location on the pilot display 8.

In block 212, the pixel location of the target is extracted from the results of block 210 and the aimpoint location on the target image from the target library 216 are combined to determine the optimized pixel position of the cursor on the display. The optimized pixel location is then loaded into a hardware register for access by the operator via the switch on the control stick. When the operator depresses the switch, the aimpoint cursor will be located at this optimized point for the operator to see. The pilot sees this assisted ATR cursor position and decides if the cursor should be further repositioned. If the pilot moves the stick position, the AOD optimized cursor input is interrupted and the cursor is controlled only by the pilots stick until after the aimpoint update switch is released.

In summary, numerous benefits are described which result from employing the concepts of the invention. The foregoing description of exemplary embodiments is presented for the purposes of illustration and description, and is not intended to be exhaustive or to limit the embodiment to the precise form disclosed. Obvious modifications or variations are possible in light of the above teachings. The described embodiments were selected and described in order to best illustrate the principles disclosed and its practical application to thereby enable one of ordinary skill in the art to best utilize various embodiments and with various modifications as are suited to particular uses contemplated. It is intended that the scope of the disclosure be defined by the claims appended hereto.

We claim:

1. A method of automatically updating an operator's display of missile seeker data, the method comprising:

receiving missile seeker data;

extracting a seeker image data from the missile seeker data;

identifying a mission target location based on a comparison of a target library data with the seeker image data;

generating an aimpoint marker at the mission target location; and outputting a position of the aimpoint marker to the operator's display.

2. The method of claim 1, wherein the received missile seeker data is annotated character data on a seeker video image.

3. The method of claim 1, wherein extracting a seeker image data further comprises:

converting the received missile seeker data into a digital format; and separating the digitally formatted missile seeker data into the seeker image data and a missile seeker annotation data.

4. The method of claim 3, further comprising:

extracting a set of images from a target image library based on a mission plan target; and modifying the extracted set of images based on a portion of the missile seeker annotation data to form the target library data.

5. The method of claim 4, wherein identifying the mission target location comprises:

extracting predetermined features and components from the seeker image data;

comparing the extracted features and components to the target library data; and identifying the mission target location based on the comparison between the extracted features and components to the target library data.

6. The method of claim 4, wherein identifying the mission target location comprises:

extracting predetermined features and components from the seeker image data;

comparing the extracted features and components to target library data;

calculating a matched target certainty data based on the comparison between the extracted features and components to the target library data;

locating a primary mission target of the seeker image data based on the matched target certainty data; and identifying the mission target location based on the location of the primary mission target.

7. The method of claim 6, wherein extracting the set of images from the target image library based on the mission plan target comprises:

receiving a mission plan data; and extracting the set of images from the target image library based on the received mission plan data.

8. The method of claim 7, wherein modifying the extracted set of images comprises:

tailoring the extracted set of images based on a range, azimuth, and elevation of the missile seeker data.

9. A system for providing automated input to a user regarding a missile target location for a missile, the system comprising:

an aircraft mission planning command processor; and an aimpoint optimization device (AOD), wherein the AOD receives a mission plan data and a missile seeker data from the command processor and sends a signal to the command processor, the signal including the missile target location for the missile.

10. The system of claim 9, wherein the AOD comprises:

an image and data processor that receives the missile seeker data from the command processor and converts the missile seeker data into a digital format, wherein the AOD further separates the digitally formatted missile seeker data into a seeker mode annotated data and a missile seeker image data.

11. The system of claim 10, wherein the AOD additionally:

extracts target images from a target image library based on the mission plan data; and modifies the extracted target images based on at least a portion of the seeker mode annotated data to form a modified target library image data.

12. The system of claim 11, wherein the AOD additionally:

identifies and locates the mission target location by comparing the missile seeker image data to the modified target library image data when the mission target location identifies a most vulnerable spot on the mission target.

13. The system of claim 12, wherein the AOD additionally:

compares the missile seeker image data to the modified target library image data;

determines a target certainty data based on the comparison between the missile seeker image data and the modified extracted target library image data;

identifies a primary mission plan target based on the target certainty data; and identify the mission target location, the mission target location identified by a pixel location of the missile seeker image data.

14. The system of claim 13, wherein the command processor additionally:

displays an aimpoint marker on a display based on the pixel location of the mission seeker image data.

15. The system of claim 14, wherein the AOD additionally:

analyzes a signal-to-noise ratio of the missile target image data and combines frames of the missile seeker image data until a threshold signal-to-noise ratio is reached.

16. The system of claim 14 wherein the display is an aircraft cockpit display.

17. The system of claim 16, further comprising:

a control stick enabled to manually update a location of the aimpoint market on the aircraft cockpit display.

18. A method for suggesting a location for a mission target for a missile, the method comprising:

receiving video data from a missile seeker, the video data being annotated;

converting the received video data into a digital image format;

analyzing the digitally formatted video data for a signal-to-noise ratio;

combining multiple frames of the digitally formatted video data until a signal-to-noise threshold is exceeded;

separating the digitally formatted video data into a missile seeker annotation data and missile seeker image data;

receiving a mission target from a mission plan;

extracting a mission target image set from a target image library based on the mission target;

modifying the mission target image set based on the missile seeker annotation data;

comparing the modified mission target image set to the missile seeker image data;

determining target certainty data based on the comparison;

locating a primary mission target based on the target certainty data; and suggesting the location for the mission target based on the primary mission target location, wherein the suggestion location for the mission target is a pixel position of the missile seeker image data.

* * * * *